US009669977B2

(12) United States Patent
Olsen et al.

(10) Patent No.: US 9,669,977 B2
(45) Date of Patent: Jun. 6, 2017

(54) CONTAINER CARRIER

(71) Applicants: Robert C. Olsen, Medinah, IL (US); Leslie S. Marco, Westmont, IL (US)

(72) Inventors: Robert C. Olsen, Medinah, IL (US); Leslie S. Marco, Westmont, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/517,155

(22) Filed: Oct. 17, 2014

(65) Prior Publication Data

US 2015/0108014 A1 Apr. 23, 2015

Related U.S. Application Data

(60) Provisional application No. 61/947,232, filed on Mar. 3, 2014, provisional application No. 61/893,707, filed on Oct. 21, 2013.

(51) Int. Cl.
*B65D 71/50* (2006.01)
*B65D 23/10* (2006.01)

(52) U.S. Cl.
CPC ..... *B65D 71/504* (2013.01); *B65D 23/102* (2013.01)

(58) Field of Classification Search
CPC ..... B65D 71/50–71/508
See application file for complete search history.

(56) References Cited

U.S. PATENT DOCUMENTS

| | | | | |
|---|---|---|---|---|
| 4,018,331 | A * | 4/1977 | Klygis | B65D 71/504 206/199 |
| 4,782,955 | A | 11/1988 | Weaver et al. | |
| 5,018,620 | A | 5/1991 | Marco et al. | |
| 5,072,829 | A * | 12/1991 | Marco | B65D 71/504 206/150 |
| 5,139,137 | A | 8/1992 | Marco | |
| 6,182,821 | B1 * | 2/2001 | Olsen | B65D 71/504 206/150 |
| 7,793,778 | B2 * | 9/2010 | Olsen | B65D 71/504 206/150 |

FOREIGN PATENT DOCUMENTS

| | | |
|---|---|---|
| EP | 0 142 360 A2 | 5/1985 |
| EP | 0 318 619 A1 | 6/1989 |
| EP | 0 997 389 A1 | 5/2000 |
| EP | 1 004 518 A2 | 5/2000 |

* cited by examiner

*Primary Examiner* — Anthony Stashick
*Assistant Examiner* — Mollie Impink
(74) *Attorney, Agent, or Firm* — Pauley Erickson & Kottis

(57) ABSTRACT

A flexible carrier for carrying a plurality of containers within a plurality of corresponding container receiving apertures formed in longitudinal rows and transverse ranks that includes three rows of container receiving apertures and a handle extending parallel to the three rows of container receiving apertures.

13 Claims, 5 Drawing Sheets

CONTAINER CARRIER

CROSS REFERENCE TO RELATED APPLICATION

This application claims priority to U.S. Provisional Application, Ser. No. 61/893,707, filed on 21 Oct. 2013 and U.S. Provisional Application, Ser. No. 61/947,232, filed on 3 Mar. 2014. These U.S. Provisional Applications are hereby incorporated by reference herein in its entirety and are made a part hereof, including but not limited to those portions which specifically appear hereinafter.

BACKGROUND OF THE INVENTION

Field of the Invention

This invention relates to a container carrier having at least three rows of container receiving apertures for unitizing a plurality of containers.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package from the top (called a "top lift carrier") or outwardly from a side of the carrier to enable a consumer to carry the package from the side (called a "side lift carrier").

Typically, larger-capacity carriers result in challenges in application to containers in that carriers having more than two rows tend to open in an undesirable sequence and thus cannot be applied at high speeds. In addition, the resulting package tends to sag at the ends when lifted resulting in a sloppy appearance. As such, a need arises for a carrier capable of carrying a large number of containers that permits high speed application and results in an aesthetically pleasing package for the consumer to handle.

SUMMARY OF THE INVENTION

The present invention is directed to a flexible carrier for packaging containers that includes an arrangement of container receiving apertures that are configured to permit placement over containers in three distinct rows.

The carrier is suitably configured with a combination of webs and container receiving apertures that permit opening up and generally even, distributed stretching for application to the containers. In the described configuration, a flexible sheet forms webs defining container receiving apertures wherein tapered oblique bands at least partially define the respective container receiving apertures and a handle is positioned parallel with the three rows of container receiving apertures. The resulting carrier is configured to enable placement over at least three rows of containers to result in a tight, unitized bricklike package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 7:
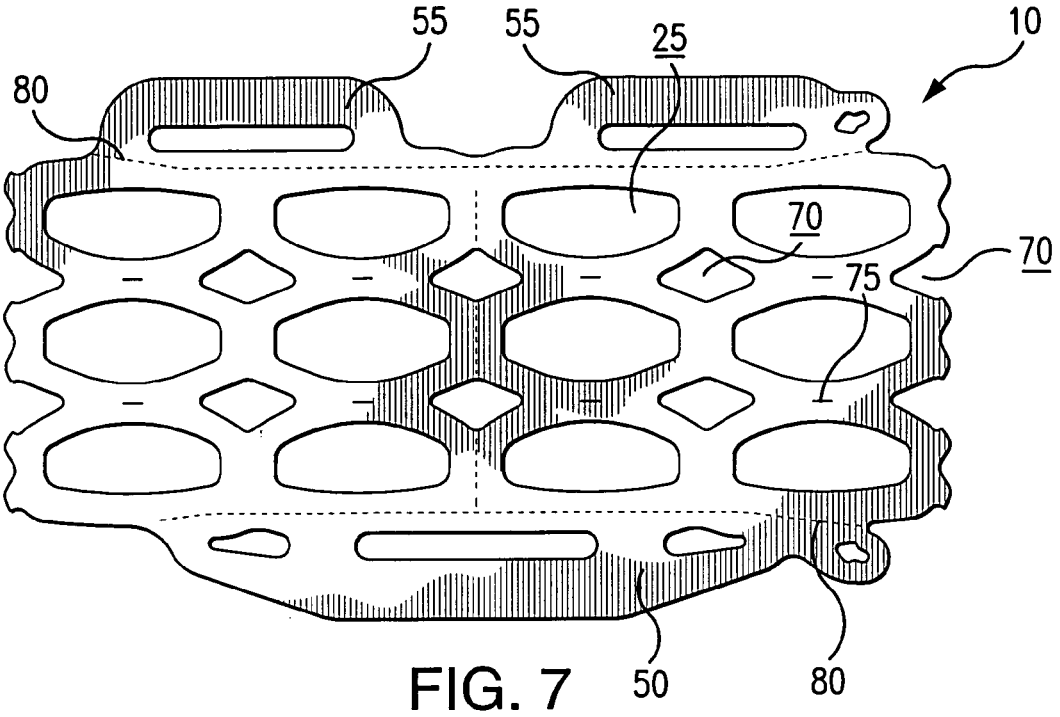
FIG. 7 is a side elevational view of a container carrier according to one preferred embodiment of this invention.
Figure 8:
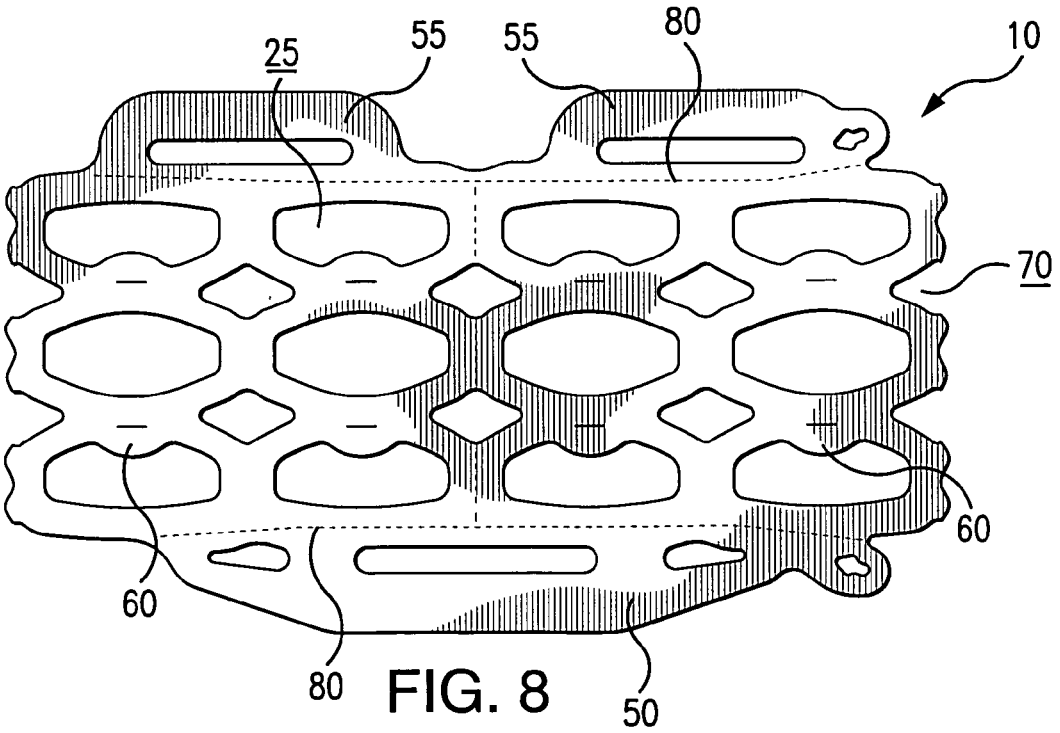
FIG. 8 is a side elevational view of a container carrier according to one preferred embodiment of this invention.
Figure 9:
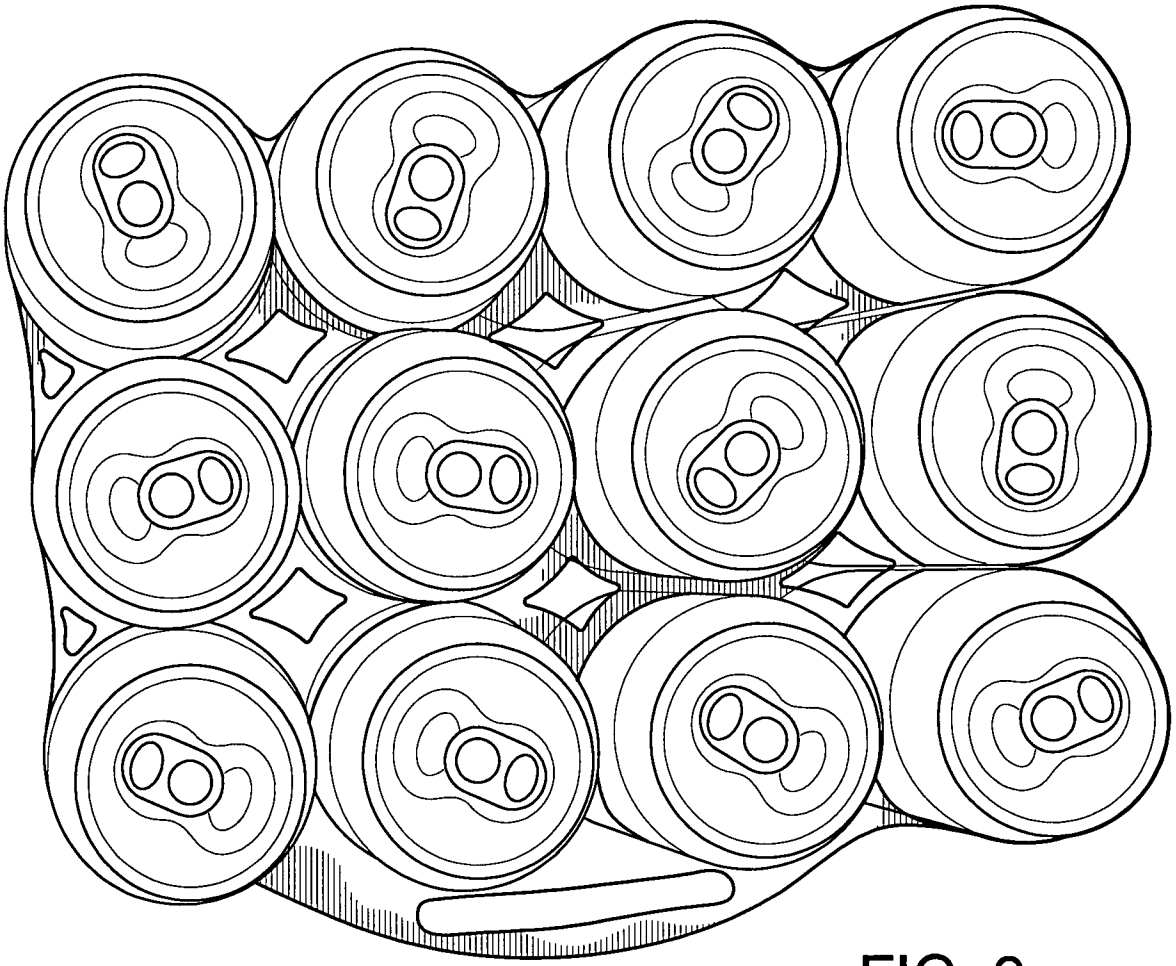
FIG. 9 is a top view of a package of unitized containers according to one preferred embodiment of this invention.

FIGS. 1-8 show flexible carrier 10 for unitizing six or more containers and a resulting unitized package, shown in one embodiment in FIG. 9. Although FIGS. 1-9 illustrate various structures for flexible carrier 10 of the invention, the illustrations are exemplary, and the invention is not limited to the flexible carriers 10 or packages shown for six, twelve or fifteen containers. For example, flexible carrier 10 may be alternatively configured and used to unitize three, nine, eighteen, or any other desired number of containers.

Containers are preferably cans, however, bottles or any other commonly unitized container may be used with flexible carrier 10 according to this invention. The containers are preferably, though not necessarily, like-sized within a single flexible carrier 10.

Figure 1:
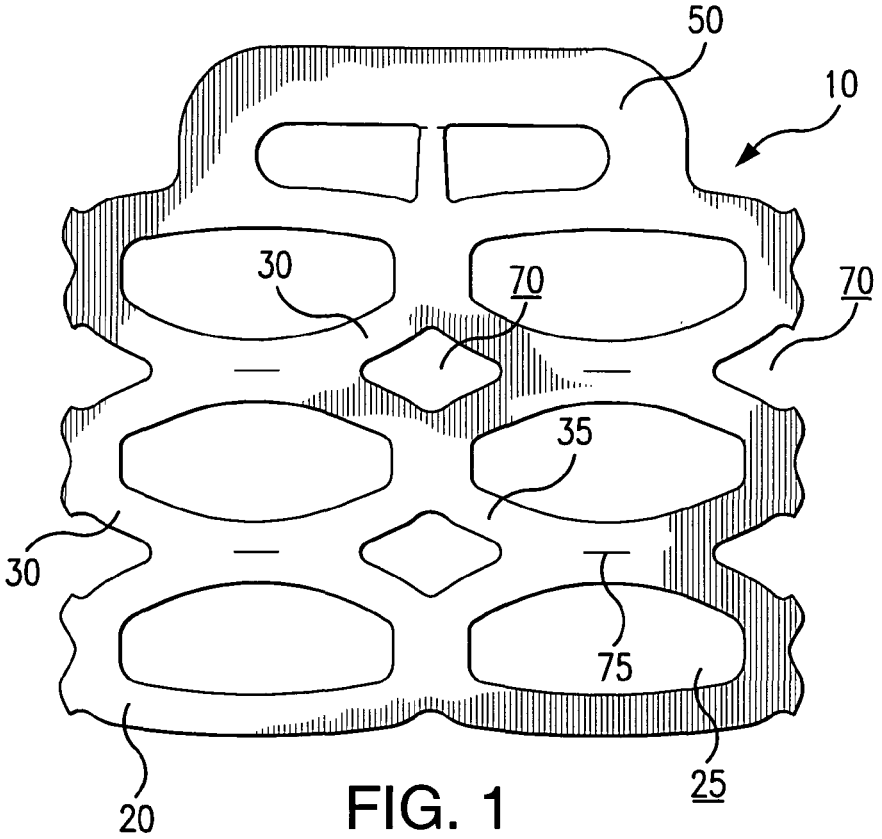
FIG. 1 is a side elevational view of a container carrier according to one preferred embodiment of this invention.
Figure 2:
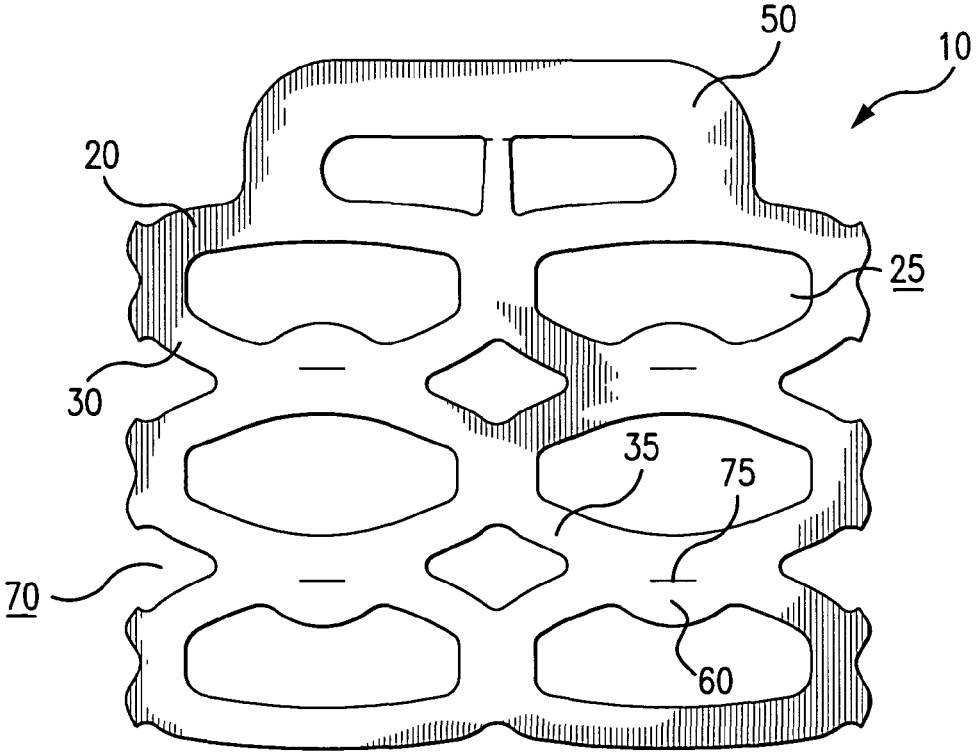
FIG. 2 is a side elevational view of a container carrier according to one preferred embodiment of this invention.
Figure 3:
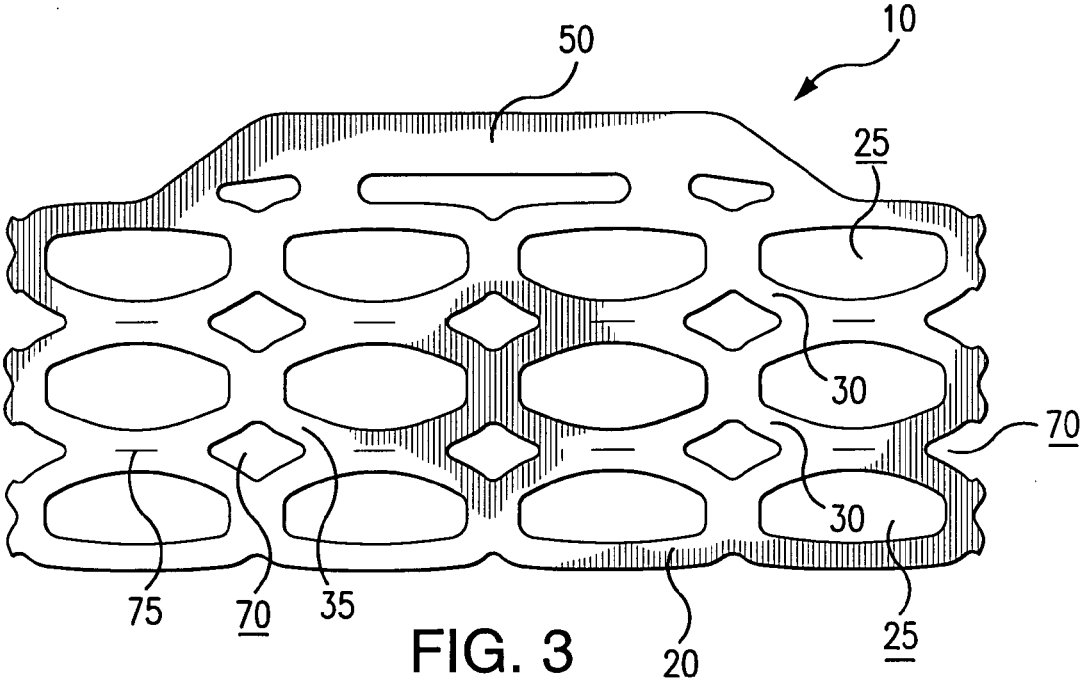
FIG. 3 is a side elevational view of a container carrier according to one preferred embodiment of this invention.
Figure 4:
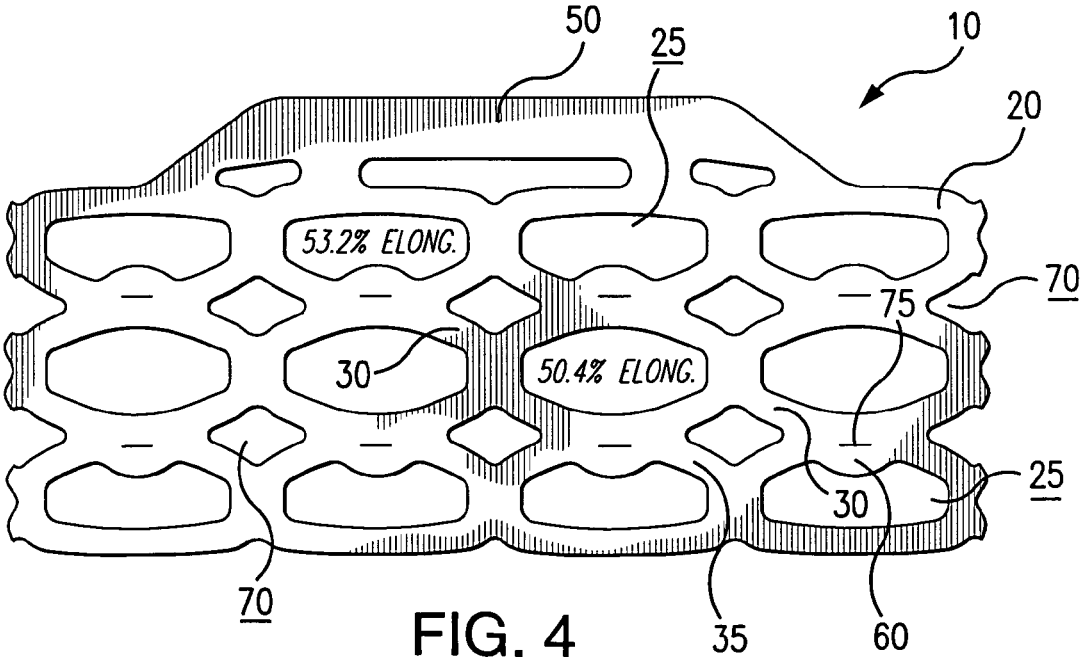
FIG. 4 is a side elevational view of a container carrier according to one preferred embodiment of this invention.
Figure 5:
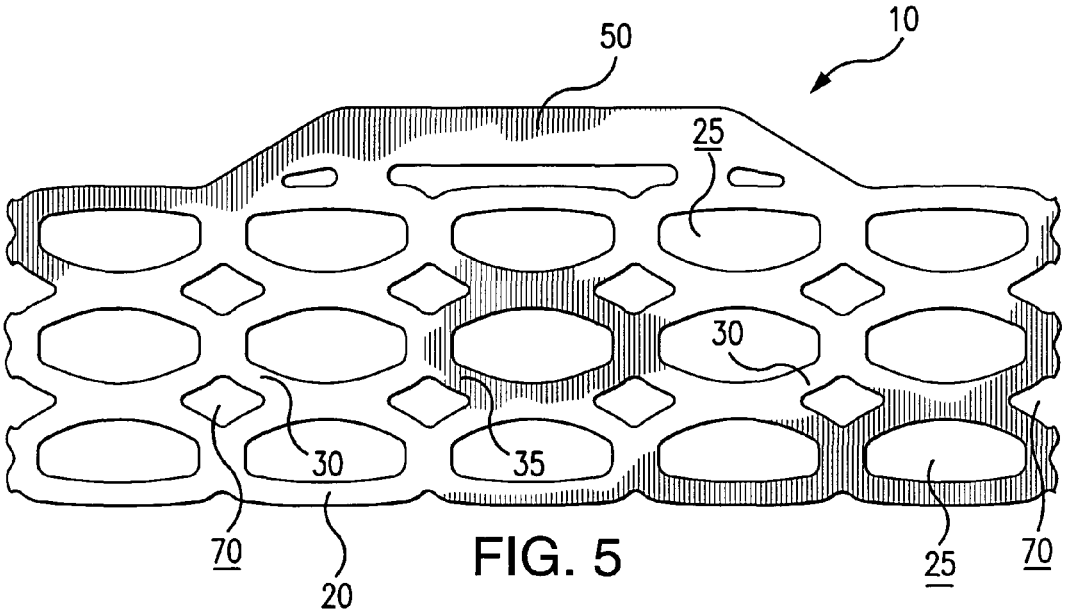
FIG. 5 is a side elevational view of a container carrier according to one preferred embodiment of this invention.
Figure 6:
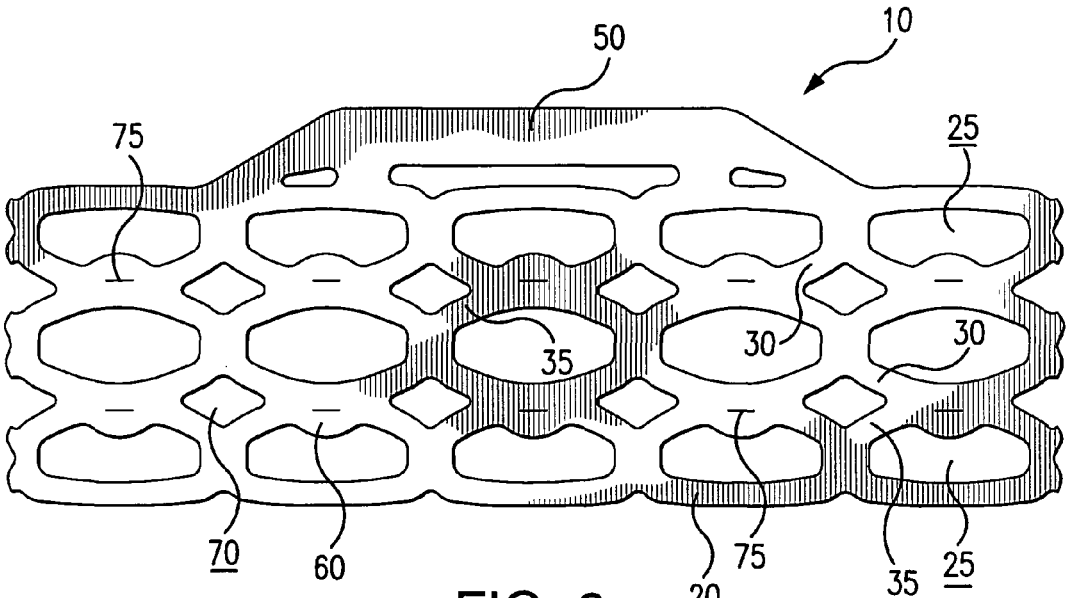
FIG. 6 is a side elevational view of a container carrier according to one preferred embodiment of this invention.

Each flexible carrier 10 preferably includes a single layer of flexible sheet 20 having a width and length defining therein a plurality of container receiving apertures 25, each for receiving a container. The plurality of container receiving apertures 25 are preferably arranged in at least three longitudinal rows and multiple longitudinal ranks so as to form an array of container receiving apertures 25, such as three rows by two ranks for a six container multipackage as shown in FIGS. 1 and 2 or three rows by four ranks for a twelve container multipackage as shown in FIGS. 3 and 4 or three rows by five ranks for a fifteen container multipackage as shown in FIGS. 5 and 6. FIGS. 7 and 8 show three rows by four dividable ranks for a dividable twelve container multipackage. Container receiving apertures 25 are preferably elongated in a longitudinal direction of flexible carrier 10.

FIG. 9 shows a representative package 100 resulting from flexible carrier 10 that includes a plurality of unitized containers. Flexible carriers 10 are generally applied to containers by stretching flexible sheet 20 surrounding container receiving apertures 25 around container, and requiring the stretched carrier 10 to recover, thereby providing a tight engagement.

A preferred carrier configuration includes three distinct parallel rows of container receiving apertures 25 including a middle row and two outer rows of container receiving apertures 25. Each rank includes three container receiving apertures 25 (one for each row in the carrier 10). Of these three container receiving apertures 25 per rank, there are two outer apertures and one center aperture formed therebetween.

As shown in FIGS. 1-8, three parallel rows of container receiving apertures 25 are preferably formed within flexible sheet 20. As such, one row of container receiving apertures 25 is preferably formed along each side of the carrier 10 and one intermediate row is formed therebetween. As shown, it is preferable that each container receiving aperture 25 in a single row is configured identically from the other. As shown, this means that each container receiving aperture 25 in the center row is identical, each container receiving aperture in one outer row is identical and each container receiving aperture 25 in the other outer row is likewise identical. Preferably, the container receiving apertures 25 in one outer row are mirror images of the other outer row.

Container receiving apertures 25 are preferably formed in a geometry that results in a uniform application of the carrier 10 to containers to produce a tight unitization of containers within flexible carrier 10. Such a result is difficult when carrier 10 is engaged with three rows of container receiving apertures 25 over three rows of containers as described herein.

In particular, one or more jaws engage with an edge of the container receiving apertures 25 in outer rows and stretch the carrier open so as to apply the carrier to individual containers. When an intermediate row is formed between the outer rows, the jaws cannot directly engage container receiving apertures in that row which results in inadequate stretching of the container receiving apertures in that row and/or misapplication of the carrier to the plurality of containers. The subject invention is configured to enable that the container receiving apertures 25 in that intermediate row to adequate stretch and engage the associated containers resulting in a desired package shown in FIG. 9.

In particular, the subject carrier 10 preferably stretches between approximately 31% and 51% thereby permitting application to a range of container diameters from 2.25" to 2.6".

As described above, container carrier 10 according to a preferred embodiment of the invention includes a series of interconnecting webs 30 that define the plurality of container receiving apertures 25. Webs 30 are stretchable around container during application and recoverable around container following application. Specifically, in the described configuration, the flexible sheet 20 forms webs 30 defining container receiving apertures 25 wherein the webs 30 are tapered oblique bands 35 at least partially defining the respective container receiving apertures 25. In particular the oblique bands 35 taper toward the web between the rows of container receiving apertures 25.

In addition, according to one embodiment container receiving apertures 25 in the outer rows are longitudinally asymmetric while the container receiving apertures 25 in the middle rows are longitudinally symmetric. The particular arrangement of apertures described enables the carrier 10 uniformly open up and stretch for application to containers despite having three rows of container receiving apertures 25.

As shown in FIGS. 1-8, a handle 50 extends from a longitudinal edge of carrier 10. Handle 50 may comprise one or more elongated apertures positioned along the outer periphery of handle 50 or may comprise a similar configuration that provides an ample area for a consumer to grasp by inserting his hand through and still maintain the purpose and integrity of package. As shown in FIGS. 7 and 8, a pair of secondary handles 55 may be positioned along a longitudinal edge of the carrier 10 opposite the edge of the handle 50. As shown in FIGS. 7 and 8, one or both of the handle 50 and/or the secondary handles 55 may be divisible along a line of weakness 80. In this manner, the package may be configured as a twelve pack or a six pack or any similar combination depending on the number of container receiving openings 25 and the configuration of the handles 50, 55 employed.

According to an embodiment of the invention shown in FIGS. 2, 4, 6 and 8, a plurality of tabs 60 are positioned within each carrier 10. Preferably, each such tab 60 extends into a container receiving aperture 25 in outer rows of the three longitudinal rows. As shown, each container receiving aperture 25 in outer rows includes only one tab 60. Further each tab 60 preferably extends from an inner portion of each container receiving aperture 25 in the outer rows. These tabs 60 form a desirable configuration in a center web of the carrier following application to containers and preferably prevent inversions in that web which would jeopardize a sturdy package and the aesthetics of the package.

As shown in the figures, the container carrier 10 may further include asymmetric dividing apertures 70 positioned between adjacent ranks of container receiving apertures 25. Further, dividing apertures 70 are preferably positioned between adjacent carriers 10 when formed in a generally continuous string of carriers prior to application.

In addition, a slit 75 is preferably positioned between each container receiving aperture 25 in a center row and an outer row. The slit 75 also assists in a desired v-shape in the center web of the carrier following application to containers.

The configuration of the carrier 10 described above includes a combination of webs and container receiving apertures that permit opening up and even stretching for application to the containers. In the described configuration, the shape and design of the center row of container receiving apertures 25 is different from that of the outer rows of container receiving apertures 25. Such a design overcomes the natural tendency of the central apertures to foreshorten during stretching.

As described, the subject carrier 10 preferably accommodates at least four different standard container sizes including 202/211; 202/209; 202/207.5 and 202/206.5 (2.6"; 2.48"; 2.36"; and 2.25" diameters, respectively). Standard container heights between approximately 250 ml to 568 ml can also utilize the subject carrier 10. In an applied condition, adjacent containers touch in a transverse direction (TD) and are spaced at various intervals depending on container size in the longitudinal or machine direction (MD). The flexibility of the carrier 10 thereby permits a single applicating machine and carrier to accommodate a whole range of containers without changeover to a new carrier. This enables a more compact footprint for equipment, minimizes required inventories for carrier stock and simplifies changeover to different multipackages.

While in the foregoing specification this invention has been described in relation to certain preferred embodiments thereof, and many details have been set forth for purpose of illustration, it will be apparent to those skilled in the art that flexible carrier 10 and package 100 susceptible to additional embodiments and that certain of the details described herein can be varied considerably without departing from the basic principles of the invention.

The invention claimed is:

1. A container carrier for unitizing a plurality of containers comprising:

a flexible web forming a plurality of container receiving apertures, each container receiving aperture elongated in the longitudinal direction, the container receiving apertures arranged in two transverse ranks and three longitudinal rows, wherein the three longitudinal rows include a center row between two outer rows and wherein each container receiving aperture is configured identically in shape and orientation to an adjacent container receiving aperture within a row;

a handle extending along one edge of the flexible web at first ends of the two transverse ranks, and extending parallel to the three longitudinal rows;

wherein the flexible web includes a series of identical longitudinally asymmetric dividing apertures positioned between adjacent ranks of container receiving apertures to form a plurality of tapered oblique bands defining the center row of container receiving apertures; and wherein the container carrier accommodates at least four different standard container sizes between 2.25" and 2.6".

2. The container carrier of claim 1 wherein container receiving apertures in the outer rows are shaped differently from container receiving apertures in the center row.

3. The container carrier of claim 1 further comprising plurality of tabs, each tab extending from the flexible web around the center row into a container receiving aperture in the outer rows of the three longitudinal rows.

4. The container carrier of claim 3 wherein each container receiving aperture in outer rows includes only one tab.

5. The container carrier of claim 1 wherein container receiving apertures in a center row are symmetric and container receiving apertures in outer rows are asymmetric.

6. The container carrier of claim 1 further comprising a slit positioned between each adjacent two container receiving apertures in each of the two transverse ranks.

7. A package formed by applying a carrier in accordance with claim 1 to a plurality of containers.

8. container carrier of claim 1 further comprising:

a plurality of tabs each extending from the flexible web between pairs of the tapered oblique bands into a container receiving aperture of the outer rows; and a slit positioned in the flexible web between each tab and the center row.

9. A container carrier for unitizing a plurality of containers comprising:

a flexible web forming a plurality of container receiving apertures, the container receiving apertures arranged in three longitudinal rows and four transverse ranks wherein the container receiving apertures in a center row are symmetric and the container receiving apertures in outer rows are asymmetric and wherein each container receiving aperture is configured identically in shape and orientation to an adjacent container receiving aperture within a row;

the flexible web including a series of identical longitudinally asymmetric dividing apertures positioned between adjacent ranks of container receiving apertures forming a plurality of tapered oblique bands defining each side of the center row of container receiving apertures;

a plurality of tabs, each tab extending from the flexible web between pairs of the tapered oblique bands into a container receiving aperture of the outer rows; and a handle positioned along one longitudinal edge of the flexible web at first ends of the four transverse ranks, and extending parallel to the three longitudinal rows and wherein the container carrier accommodates at least four different standard container sizes between 2.25" and 2.6".

10. The container carrier of claim 9 further comprising a pair of secondary handles extending along an opposite longitudinal edge as the handle.

11. The container carrier of claim 10 wherein the secondary handles are divisible along a line of weakness.

12. The container carrier of claim 9 further comprising a slit in the flexible web positioned between each tab and the center row.

13. The container carrier of claim 9 wherein each container receiving aperture in the outer rows includes only one tab.

* * * * *